US007500700B2

(12) United States Patent
Kunst

(10) Patent No.: US 7,500,700 B2
(45) Date of Patent: Mar. 10, 2009

(54) MOTOR VEHICLE DOOR LATCH

(75) Inventor: Frank Kunst, Lüdinghausen (DE)

(73) Assignee: Kiekert AG, Heiligenhaus (DE)

( * ) Notice: Subject to any disclaimer, the term of this patent is extended or adjusted under 35 U.S.C. 154(b) by 328 days.

(21) Appl. No.: 10/566,394

(22) PCT Filed: Jul. 15, 2004

(86) PCT No.: PCT/DE2004/001537

§ 371 (c)(1),
(2), (4) Date: Jan. 30, 2006

(87) PCT Pub. No.: WO2005/012676

PCT Pub. Date: Feb. 10, 2005

(65) Prior Publication Data

US 2006/0202488 A1 Sep. 14, 2006

(30) Foreign Application Priority Data

Aug. 1, 2003 (DE) ..... 103 36 049

(51) Int. Cl.
*E05C 3/06* (2006.01)
*E05C 3/16* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 5,360,351 | A | 11/1994 | Periou et al. | |
| 5,938,252 | A * | 8/1999 | Uemura et al. | 292/201 |
| 6,109,674 | A * | 8/2000 | Bartel et al. | 292/337 |
| 6,371,537 | B1 * | 4/2002 | Vige et al. | 292/201 |
| 6,390,517 | B1 * | 5/2002 | Ehret | 292/201 |
| 6,945,574 | B2 * | 9/2005 | Hayakawa et al. | 292/201 |

FOREIGN PATENT DOCUMENTS

| | | | |
|---|---|---|---|
| DE | 101 00 008 | A1 | 7/2002 |
| EP | 0 812 972 | A2 | 12/1997 |
| EP | 0 894 924 | A1 | 2/1999 |
| EP | 0 959 205 | A1 | 11/1999 |
| EP | 1 087 082 | A2 | 3/2001 |
| FR | 2 753 738 | A1 | 3/1998 |

* cited by examiner

*Primary Examiner*—Carlos Lugo
(74) *Attorney, Agent, or Firm*—Matthias Scholl, PC; Matthias Scholl

(57) ABSTRACT

A motor vehicle door latch having a locking mechanism (1, 2) and a base housing (6). The locking mechanism (1, 2) is optionally lodged in connection with other lock components (3, 4, 5) in the base housing (6) and forms a base module (1, 2, 3, 4, 5, 6) with the base housing. The base module (1, 2, 3, 4, 5, 6) is designed to receive a complementary module (7, 8, 9, 10, 11, 12) with a drive mechanism (8, 9, 10, 11) for opening the locking mechanism (1, 2).

14 Claims, 4 Drawing Sheets

MOTOR VEHICLE DOOR LATCH

CROSS-REFERENCE TO RELATED APPLICATIONS

This is a National Stage Application of International Patent Application No. PCT/DE 2004/001537, with an international filing date of Jul. 15, 2004, which is based on German Patent Application No. 103 36 049.2, filed Aug. 1, 2003. The contents of both of these specifications are incorporated herein by reference.

BACKGROUND OF THE INVENTION

1. Field of the Invention

The invention relates to a motor vehicle door latch with a locking mechanism and a base housing in which the locking mechanism is optionally lodged in connection with other lock components in the base housing and forms a base module with said housing.

2. Description of Related Art

Such a motor vehicle door latch is, for instance, disclosed in U.S. Pat. No. 6,059,328. This invention already shows to some extent a modular structure in which the individual elements are arranged inside the different housing components.

Such motor vehicle door latches have been successfully used, are however limited if they are to be based on the same design concept and an option for motorized opening of the locking mechanism is to be provided. This is where the invention provides a solution.

BRIEF DESCRIPTION OF THE DRAWINGS

Below, the invention is explained in more detail with reference to drawings showing only one embodiment, in which.

BRIEF SUMMARY OF THE INVENTION

Figure 2:
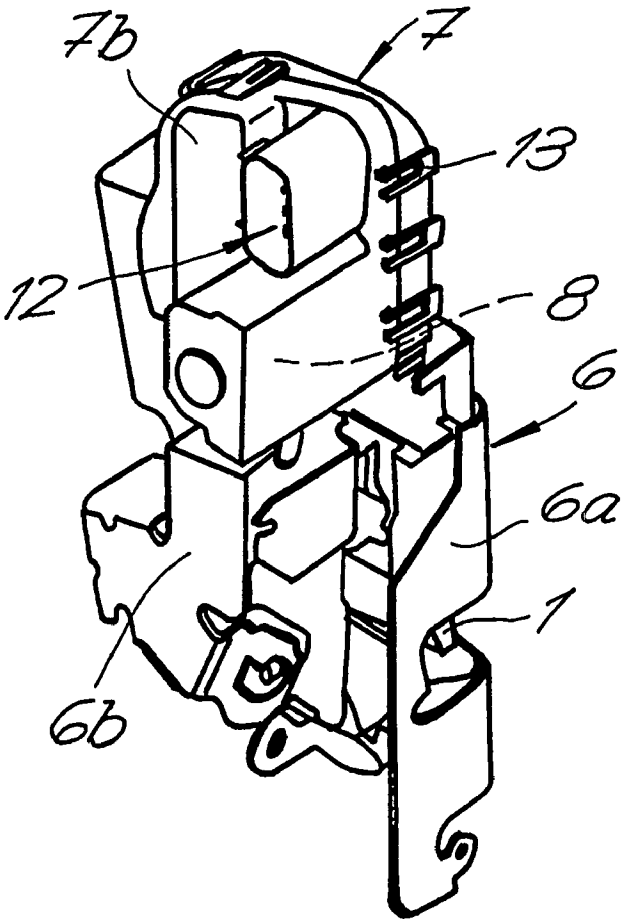
FIG. 2 shows the object of FIG. 1 in an assembled state from a different angle.

The invention described herein provides a motor vehicle door latch with a locking mechanism (1, 2) and a base housing (6), in which the locking mechanism is optionally lodged in connection with other lock components (3, 4, 5) in the base housing (6) and forms a base module (1, 2, 3, 4, 5, 6) with said housing, in which for accommodating a complementary module (7, 8, 9, 10, 11, 12), the base module (1, 2, 3, 4, 5, 6) contains a drive (8, 9, 10, 11) for opening the locking mechanism (1, 2).

In certain embodiments of the invention described herein, the complementary module (7, 8, 9, 10, 11, 12) contains at least one electric motor (8) and a secondary gear (9, 10) in a complementary housing (7).

In certain embodiments of the invention described herein, the complementary housing (7) contains two parts, a gear housing shell (7*a*) and a motor/connection housing shell (7*b*).

In certain embodiments of the invention described herein, both housing shells (7*a*, 7*b*) are releasably connected to each other by, e.g. a snap-in (13) or clip connection.

In certain embodiments of the invention described herein, the base housing (6) contains a head-sided opening (16) with an operating arm (5*a*) of release lever (5) in the area of said opening.

In certain embodiments of the invention described herein, the complementary housing (7) contains a base-sided slot (17) with an output-sided gear member (10) of the drive (8, 9, 10, 11) being arranged in the area of said slot (17).

In certain embodiments of the invention described herein, the output-sided gear member (10) contains a release cam (11, 11'), interacting with the operating arm (5*a*) of the release lever (5).

In certain embodiments of the invention described herein, the complementary module (7, 8, 9, 10, 11, 12) also contains a blocking means (20) for the drive (8, 9, 10).

In certain embodiments of the invention described herein, the blocking means (20) is acted upon by a transfer element (4) projecting from the base module (1, 2, 3, 4, 5, 6).

DETAILED DESCRIPTION OF THE INVENTION

The invention relates to a motor vehicle door latch with a locking mechanism and a base housing in which the locking mechanism is optionally lodged in connection with other lock components in the base housing and forms a base module with said housing. This means that the locking mechanism together with optionally the other lock components and the base housing forms the base module.

The other lock components may be an operating lever, locking lever, etc. Generally, this is at least one operating lever and one release lever, allowing the locking mechanism to be opened.

The invention aims to solve the technical problem of further developing a motor vehicle door latch of the embodiment described above in such a way that it can easily be upgrade for motorized opening of the locking mechanism, whilst using the same basic concept.

In order to solve this technical problem, the invention provides a generic motor vehicle door latch, characterized by the base module and the base housing—containing the locking mechanism—and the other lock components for accommodating a complementary module, containing a drive for opening the locking mechanism. This means that the complementary module contains the required drive for allowing motorized opening of the locking mechanism. The complementary module and base housing can be easily combined.

The complementary module can at least contain one electric motor and a secondary gear in a complementary housing. The invention starts from the fact that such an electric motor usually moves at high speed and requires a secondary reducing gear. In this context, the use of spur gears has proven to be successful in order to reduce the space required to a minimum.

It is advantageous to design the complementary housing as a two-part housing with a gear housing shell and a motor/connection housing shell. With this design, the gear housing shell primary houses the individual gear elements, i.e. in most cases the spur wheels. The motor/connection housing shell, on the other hand, only houses, in most cases, the electric motor and connection plug, a connection socket or a similar electrical connection device through which power is supplied to the electric motor.

Both housing shells can be advantageously detachably connected to each other to facilitate assembly and allow upgrading or replacement for reasons of repair. The detachable connection can, in particular, be a snap-in or clip connection or can also consist of other connection measures.

On its base, the complementary housing normally has at least one connection web for coupling to the head of the base housing. In most cases, two connection webs are provided with approximately the same length and attached to the complementary housing at opposing sides. The head of the base housing is thus connected to the base of the complementary housing. For this purpose, the base housing contains an opening in its head, whilst the complementary housing contains a slot in its base.

In the area of the opening in the base housing head, an operating arm of a release lever may be located. The area around the slot on the complementary housing base contains, on the other hand, an output-side gear member of the drive. The output-side gear member supports a release cam interacting with the operating arm of the release lever.

When, therefore, the head of the base housing is joined to the base of the complementary housing, with the opening in the head of the base housing and the slot in the base of the complementary housing being adapted to each other, they automatically overlap the operating areas of, on one hand, the release cam on the output-side gear member of the drive and, on the other hand, of the release lever. The aforementioned interaction does thus occur automatically. The drive is therefore able to act upon the operating arm of the release lever via the output-side gear member and the release cam, located there. In the simplest embodiment this means that the release lever is displaced, opening the locking mechanism by (electrical) motor, as explained in further detail with reference to the drawings.

Apart from the drive for opening the locking mechanism, the complementary module may also contain a blocking means for the drive. With the aid of this blocking means, the drive can be blocked in its blocking position to prevent unintentional opening of the locking mechanism. Only once the blocking means is in its release position, can the drive open the locking mechanism. The change from a regularly assumed blocking position to a release position is, in most cases, activated by manual movement by a user wishing to enter the vehicle, said movement being transferred to the blocking means in order to transfer it from the blocking position into the release position. In order to implement this process, the blocking means is, in most cases, acted upon by a transfer element projecting from the base module.

The invention thus provides a motor vehicle door latch, offering an advantageous particular modular design. The base module does, indeed, contain all main lock components required for mechanical opening the locking mechanism. This includes, for instance, the release lever but also, at least, an operating arm. The embodiment may also contain a locking lever that may also be designed as a central locking lever. Where such a base module is to be combined with a device for motorized opening of the locking mechanism, this can, according to the invention, be achieved by evenly flanging the complementary module to the base module. The complementary module contains the required drive for opening the locking mechanism with the base module allowing the accommodation of the complementary module.

In detail this is achieved by the invention by providing an opening on the head of the base module and a corresponding slot in the foot of the complementary module that are mainly overlapping and are arranged in relation to each other, taking into consideration the connection webs, providing the connection between the base module and the complementary module.

As a result of this overlap and components required near the opening and slot—operating arm of the release lever and release cam of the output-side gear member—an operative connection is automatically created from the drive via the secondary gear, the release lever and finally the locking mechanism. The desired additional functionality is thus immediately achieved upon joining the base module and the complementary module. These constitute the main advantages of the invention.

The figures show a motor vehicle door latch comprising a locking mechanism 1, 2 consisting of a catch 1 and a pawl 2. The embodiment also contains other lock components in form of an operating lever 3, a transfer member 4 and a release lever 5. These other lock component 3, 4, 5 are accommodated together with the locking mechanism 1, 2 in a base housing 6 and form together with the base housing 6 a base module 1, 2, 3, 4, 5, 6.

The base housing 6 consists, on one hand, of two components, a L-shaped frame box 6*a* supporting the individual axes for the locking mechanism 1, 2 and the other lock components 3, 4, 5, and a back plate 6*b*, completing the base housing 6.

According to the invention, the base module 1, 2, 3, 4, 5, 6 is designed to accommodate a complementary module 7, 8, 9, 10, 11, 12. The complementary module 7, 8, 9, 10, 11, 12 contains a drive 8, 9, 10, 11 for opening the locking mechanism 1, 2. Actually, the drive consists of an electric motor 8 and a secondary gear 9, 10 comprising two intermeshing spur wheels 9, 10. In this embodiment, the output-side spur wheel 10 and the output-side gear member 10 contain a cam 11. Actually, the embodiment contains two cams or release cams 11, 11'.

Figure 3:
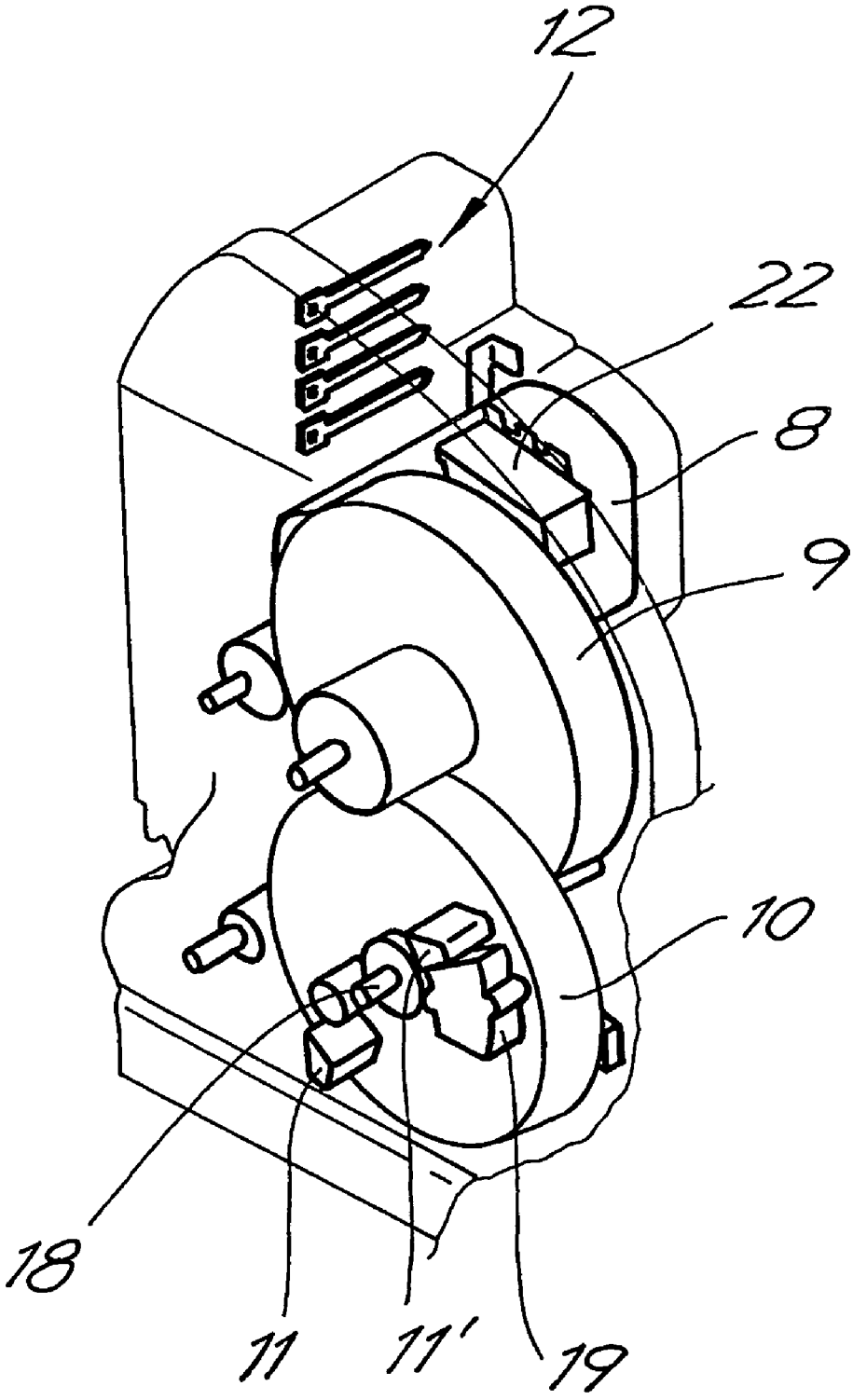
FIG. 3 shows the complementary module in detail.

The complementary module 7, 8, 9, 10, 11, 12 further includes a complementary housing 7 that, apart from the already described drive 8, 9, 10, 11 also accommodates connection devices 12. In the embodiment, the connection devices 12 comprise a socket contact connected to a connecting line for supplying the electrical motor 8—not shown in detail (see FIG. 3).

Figure 1:
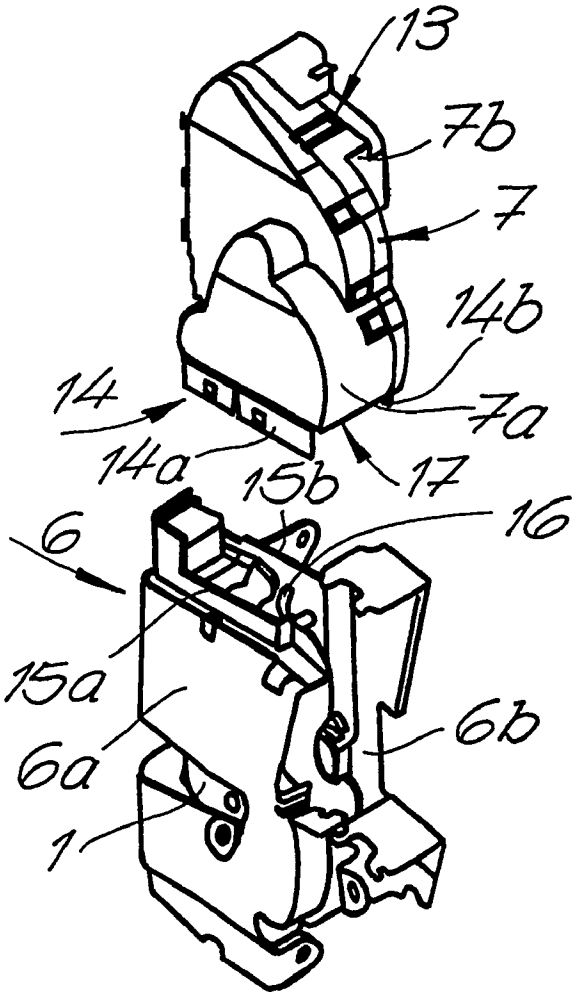
FIG. 1 shows the motor vehicle door latch of the invention in an exploded view of the base module and the complementary module.

The complementary housing 7 consists, like the base housing 6, of two parts with a gear housing shell 7*a* and a motor/connection housing shell 7*b*. Both housing shells 7*a*, 7*b* are releasably detached to each other. The invention uses a clip connection 13 at this point. The gear housing shell 7*a* primarily accommodates the two spur wheels 9, 10 and the release cams 11, 11' on the output-side spur wheel 10, whilst the motor/connection housing shell 7*b* houses the electric motor 8 and the connection device 12 (see FIGS. 1 and 3).

In order to connect the base module 1, 2, 3, 4, 5, 6 with the complementary module 7, 8, 9, 10, 11, 12, the complementary housing 7 contains at least one connection web 14 on its base. The embodiment shows two opposing, approximately equally long connection webs 14*a*, 14*b* with connection web 14*a* being attached to the gear housing shell 7*a*, whilst the motor/connection housing shell 7*b* contains the other connection web 14*b* (see FIG. 1).

The two connection webs 14*a*, 14*b* can be coupled to connection webs 15*a*, 15*b* provided on the head of the base housing 6. One connection web 15*a* is attached to the frame box 6*a*, whilst the other connection web 15*b* is part of the back plate 6*b*. The connection webs 14*a*, 14*b* and the connection webs 15*a*, 15*b* frame an opening 16 on the head of the base housing 6 and a slot 17 on the base of the complementary housing 7. The head-sided opening 16 and the base-sided slot 17 are, like the respective webs 14*a*, 14*b* and 15*a*, 15*b* adapted to and overlap each other so that the base module 1, 2, 3, 4, 5, 6 can be joined to the complementary module 7, 8, 9, 10, 11,12 by, e.g. screwing.

In the area of the head-sided opening 16 of the base housing 6, an operating arm 5*a* of the release lever is arranged. The area of the base-sided slot 17 of the complementary module 7 contains, on the other hand, the output-sided gear member or spur wheel 10 with release cams 11, 11'. The two release cams 11 and 11' are actually provided and are arranged opposite each other in relation to an axis 18 of the output-sided gear member 10. A stop 19 on the housing ensures that rotational movements of the output-sided gear member 10 are limited to a certain stipulated angle of rotation, as the respective release cam 11 or 11' comes into contact with stop 19 (see FIGS. 5*a* and 5*b*).

Figure 4B:
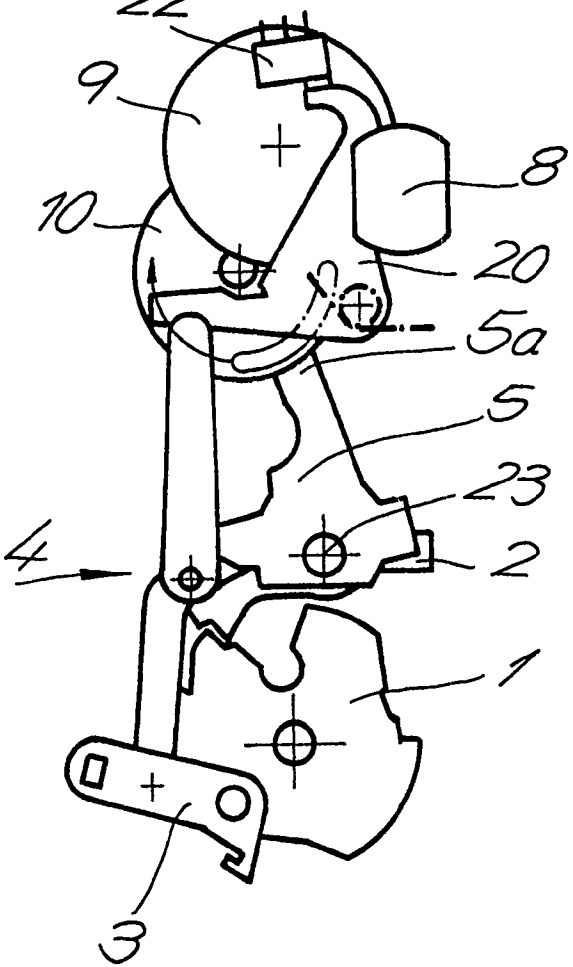
FIGS. 4*a* and 4*b* show the components of the motor vehicle door latch without housing from the front.
Figure 4A:
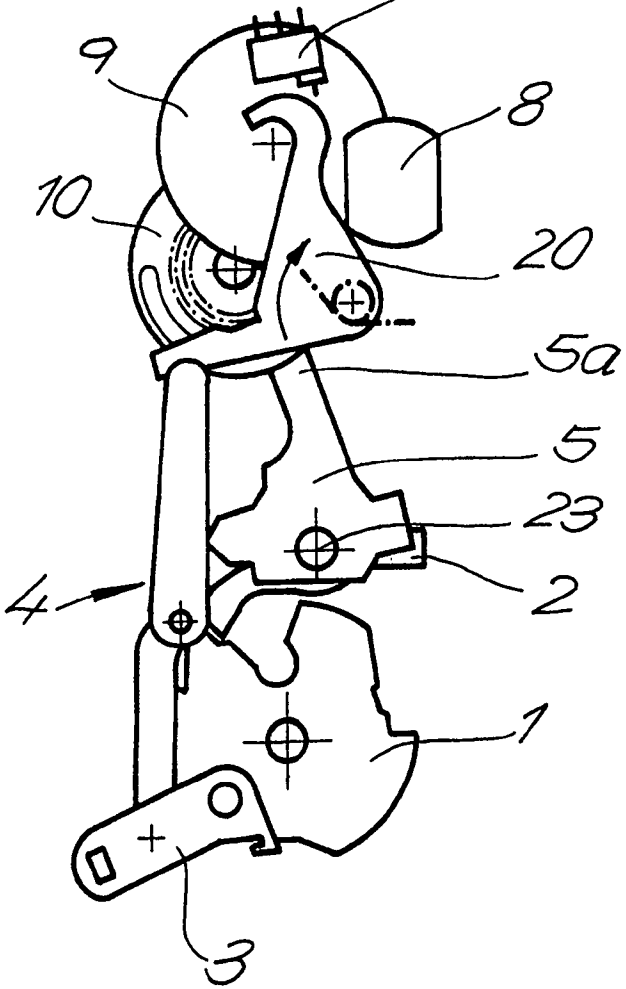

The complementary module 7, 8, 9, 10, 11, 12, also contains a blocking means shown, in particular, in FIGS. 4 and 5, said blocking means being a blocking lever 20. The blocking means 20 can be removed from a blocking position for drive 8, 9, 10, 11 (see FIG. 4*a*) into a release position, as shown in FIG. 4*b*. According to the embodiment this occurs manually by the operating lever or the external operating lever 3 being displaced in clockwise direction in the transition from FIG. 4*a* to FIG. 4*b* and acting accordingly upon the blocking means 20 with the aid of the transfer element 4 projecting from the base module 1, 2, 3, 4, 5, 6.

The embodiment functions as follows. The locking mechanism 1, 2 of the base module 1, 2, 3, 4, 5, 6 can be mechanically opened by the operating arm 3 acting on the release lever 5 with the aid of the transfer element in such a way that said release lever 5 moves the pawl 2 counterclockwise over a projection 21 during the transition from FIG. 5*a* to FIG. 5*b*, thus releasing the pawl 1. It is understood that, where applicable, prior to this or simultaneous to this process, a locking lever is moved from a "locked" position into an "unlocked" position.

If, however, the base module 1, 2, 3, 4, 5, 6 contains a complementary module 7, 8, 9, 10, 11, 12, the locking mechanism 1, 2 can—also—be opened by motor force with the aid of electrical motor 8. For this purpose, initially blocking means 20 or blocking lever 20 must be moved from its blocking position as shown in FIG. 4*a* to its released position, as shown in FIG. 4*b*. For this purpose, the operating lever or external operating lever 3 is externally manually moved in clockwise direction so that also blocking lever 20 carries out a clockwise movement during the transition from FIG. 4*a* to FIG. 4*b*.

During this process, the blocking lever 20 actuates a sensor 22 in form of a momentary-contact switch, documenting that the blocking lever 20 is in the release position and, at the same time, acts upon the electric motor 8, to electrically open the locking mechanism 1, 2.

Figure 5B:
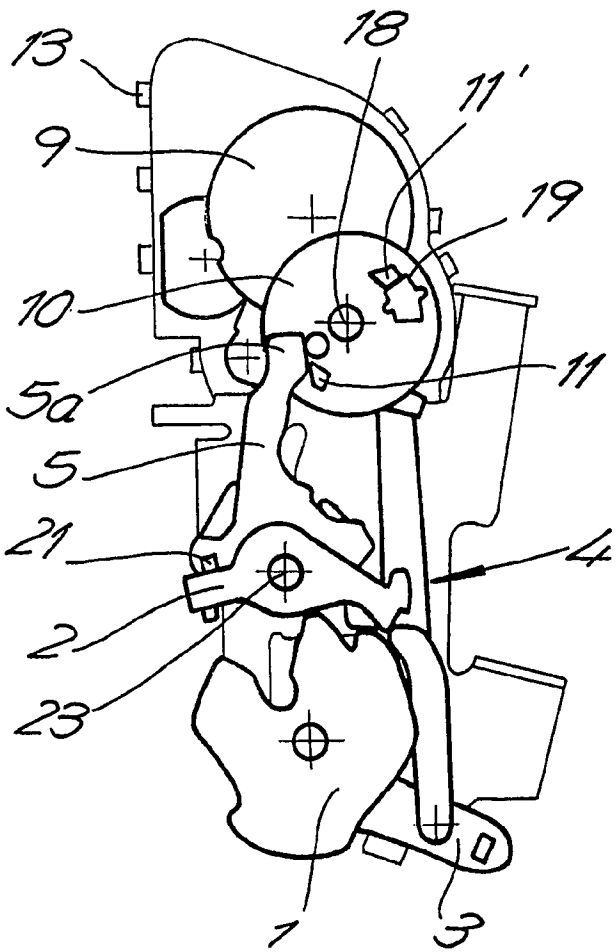
FIGS. 5*a* and 5*b* show the object of FIGS. 4*a* and 4*b* from the rear.
Figure 5A:
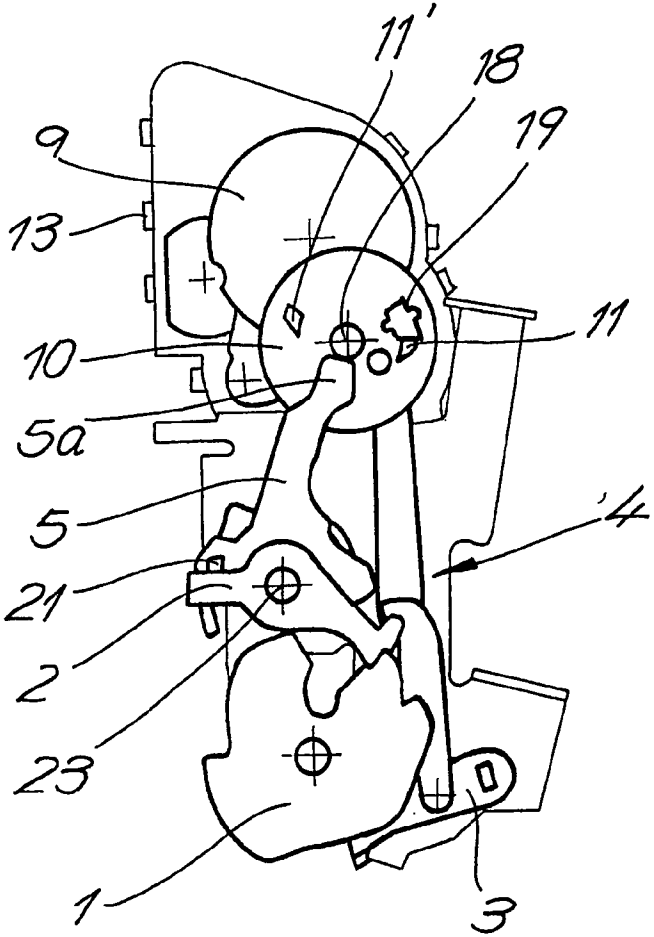

As a consequence, the output-sided gear member 10 with release cams 11, 11' leave the stop 19 fixed to the housing and moves, during the transition from FIG. 5*a* to FIG. 5*b* in clockwise direction towards the operating arm 5*a* of the release lever 5. As a result of the release cam 11 moving against the operating arm 5*a*, the release lever 5 is moved counterclockwise in relation to its axis 23 so that cam 21 on release lever 5 moves the pawl 2 arranged on the same axis and also in counterclockwise direction. The catch 1 is released and can open with the aid of a spring.

What is claimed is:

1. A motor vehicle door latch comprising:

a base module; said base module comprising a catch (1), a pawl (2), an operating lever (3), a transfer member (4), a release lever (5), and a base housing (6); said catch (1), said pawl (2), said operating lever (3), said transfer member (4), and said release lever (5) being disposed within said base housing (6);

a complementary module connectable with said base module; said complementary module comprising a complementary housing (7) and a drive for opening said catch; said drive comprising a sensor (22), an electric motor (8), blocking means (20), and at least one intermeshing spur wheel (9, 10) having at least one release cam (11, 11'), and said drive being disposed within said complementary housing;

wherein said operating lever (3) is rotatably connected to said catch (1);

said transfer member (4) is connected to said operating lever (3);

said release lever (5) is coaxial with and engageable with said pawl (2);

said transfer member (4) and said release lever (5) are each engagable with said drive when said base module and said complementary module are connected to one another; and said operating lever (3) is movable between a blocking position and a release position; and when said operating lever (3) is moved into said release position, said operating lever (3) acts upon said transfer member (4), whereby said transfer member (4) engages said blocking means (20), said blocking means (20) engages said sensor (22), said sensor (22) signals said motor (8) to turn said spur wheel, said motor (8) turns said spur wheel (10), said spur wheel (10) acts via said release cam upon said release lever (5), and said release lever (5) rotates said pawl (2) whereby opening said catch (1).

2. The latch of claim 1, wherein said base module further comprises a first connection web, and said complementary module further comprises a second connection web, said first connection web and said second connection web being engageable with one another whereby forming a connection between said base module and said complementary module.

3. The latch of claim 1, wherein said complementary housing (7) contains a slot (17); and when said base module and said complementary module are connected to one another, said transfer member (4) and said release lever (5) are inserted into and disposed in said slot (17).

4. The latch of claim 1, wherein said complementary housing (7) comprises a gear housing shell (7*a*) and a motor/connection housing shell (7*b*); said gear housing shell (7*a*) and said motor/connection housing shell (7*b*) being two separate parts.

5. The latch of claim 4, wherein said gear housing shell (7*a*) and said motor/connection housing shell (7*b*) are releasably connected to each other via a connection selected from the group of a snap-in connection (13) and a clip connection.

6. The latch of claim 1, wherein when said base module and said complementary module are not connected to one another, when acted upon manually said operating lever (3) releases said pawl (2) whereby opening said catch (1) without assistance from said motor (8).

7. A motor vehicle door latch comprising:

a base module; said base module comprising a catch (1), a pawl (2), an operating lever (3) movable between a blocking position and a release position, a transfer member (4), a release lever (5), and a base housing (6); said catch (1), said pawl (2), said operating lever (3), said transfer member (4), and said release lever (5) being disposed within said base housing (6); and a complementary module connectable with said base module; said complementary module comprising a complementary housing and a drive for opening said catch; said drive comprising a sensor (22), an electric motor (8), blocking means (20), and at least one intermeshing spur wheel (9, 10) having at least one release cam (11, 11'), and said drive being disposed within said complementary housing; wherein said operating lever (3) is rotatably connected to said catch (1);

said transfer member (4) is connected to said operating lever (3);

said release lever (5) is coaxial with and engageable with said pawl (2);

said transfer member (4) and said release lever (5) are each engagable with said drive when said base module and said complementary module are connected to one another;

when said operating lever (3) is moved into said release position, said transfer member (4) engages said drive, said drive engages said release lever (5), and said release lever (5) rotates said pawl (2) whereby opening said catch (1); and when said operating lever (3) is moved into said release position, said operating lever (3) acts upon said transfer member (4), whereby said transfer member (4) engages said blocking means (20), said blocking means (20) engages said sensor (22), said sensor (22) signals said motor (8) to turn said spur wheel, said motor (8) turns said spur wheel (10), said spur wheel (10) acts via said release cam upon said release lever (5), and said release lever (5) rotates said pawl (2) whereby opening said catch (1).

8. The latch of claim 7, wherein said base module further comprises a first connection web, and said complementary module further comprises a second connection web, said first connection web and said second connection web being engageable with one another whereby forming a connection between said base module and said complementary module.

9. The latch of claim 7, wherein said complementary housing (7) contains a slot (17), and when said base module and said complementary module are connected to one another, said transfer member (4) and said release lever (5) are inserted into said slot (17).

10. The latch of claim 7, wherein said complementary housing (7) comprises a gear housing shell (7*a*) and a motor/connection housing shell (7*b*); said gear housing shell (7*a*) and said motor/connection housing shell (7*b*) being two separate parts.

11. The latch of claim 10, wherein said gear housing shell (7*a*) and said motor/connection housing shell (7*b*) are releasably connected to each other via a connection selected from the group of a snap-in connection (13) and a clip connection.

12. The latch of claim 7, wherein when said base module and said complementary module are not connected to one another, when acted upon manually said operating lever (3) releases said pawl (2) whereby opening said catch (1) without assistance from said motor (8).

13. A motor vehicle door latch comprising:

a base module; said base module comprising a catch (1), a pawl (2), an operating lever (3) movable between a blocking position and a release position, a transfer member (4), a release lever (5) with a projection (21), and a base housing (6) having a first connection web; said catch (1), said pawl (2), said operating lever (3), said transfer member (4), and said release lever (5) being disposed within said base housing (6); and a complementary module connectable with said base module; said complementary module comprising a complementary housing having a second connection web, an electric motor (8), blocking means (20), a sensor (22), and at least a pair of intermeshing spur wheels (9, 10) having at least one release cam (11, 11'); said electric motor (8), said blocking means (20), said sensor (22), and said spur wheels (9, 10) being disposed within said complementary housing;

wherein said operating lever (3) is rotatably connected to said catch (1);

said transfer member (4) and said operating lever (3) form a crank;

said release lever (5) is coaxial with and engageable with said pawl (2) by means of said projection (21);

said first connection web and said second connection web are engageable with one another whereby forming a connection between said base module and said complementary module; and when said base module and said complementary module are connected to one another and said operating lever (3) is moved into said release position, said operating lever (3) acts upon said transfer member (4), whereby said transfer member (4) engages said blocking means (20), said blocking means (20) engages said sensor (22), said sensor (22) signals said motor (8) to turn said spur wheel, said motor (8) turns said spur wheel (10), said spur wheel (10) acts by means of said release cam upon said release lever (5), and said release lever (5) rotates said pawl (2) whereby opening said catch (1).

14. The latch of claim 13, wherein when said base module and said complementary module are not connected to one another and when said operating lever (3) is acted upon manually, said operating lever (3) releases said pawl (2) whereby opening said catch (1).

* * * * *